US007937034B2

(12) United States Patent
Thayer et al.

(10) Patent No.: US 7,937,034 B2
(45) Date of Patent: May 3, 2011

(54) BLADE ENGAGEMENT APPARATUS FOR IMAGE FORMING MACHINES

(75) Inventors: Bruce E. Thayer, Webster, NY (US); Cheryl A. Linton, Webster, NY (US); Richard W. Seyfried, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 448 days.

(21) Appl. No.: 12/201,738

(22) Filed: Aug. 29, 2008

(65) Prior Publication Data

US 2010/0054830 A1 Mar. 4, 2010

(51) Int. Cl.
*G03G 15/00* (2006.01)
*G03G 21/00* (2006.01)

(52) U.S. Cl. ..... 399/350; 399/71; 399/351

(58) Field of Classification Search ..... 399/71, 399/350, 351

See application file for complete search history.

(56) References Cited

U.S. PATENT DOCUMENTS

| | | | | |
|---|---|---|---|---|
| 5,208,639 | A | 5/1993 | Thayer et al. | |
| 5,212,527 | A * | 5/1993 | Fromm et al. | 399/326 |
| 5,264,904 | A | 11/1993 | Audi et al. | |
| 5,546,165 | A | 8/1996 | Rushing et al. | |
| 5,610,699 | A | 3/1997 | Yu et al. | |
| 5,778,296 | A | 7/1998 | van der Steen et al. | |
| 6,438,329 | B1 | 8/2002 | Budnik et al. | |
| 2003/0232262 | A1 | 12/2003 | Yamada et al. | |
| 2006/0001911 | A1 | 1/2006 | Viassolo et al. | |
| 2006/0115285 | A1 | 6/2006 | Thayer | |
| 2007/0020005 | A1 | 1/2007 | Shigezaki et al. | |
| 2007/0139496 | A1 | 6/2007 | Leighton et al. | |
| 2007/0182800 | A1 | 8/2007 | Fioravanti et al. | |
| 2009/0110416 | A1 * | 4/2009 | Thayer et al. | 399/34 |
| 2009/0190975 | A1 * | 7/2009 | Thayer et al. | 399/350 |
| 2009/0304402 | A1 * | 12/2009 | Thayer et al. | 399/44 |
| 2009/0304406 | A1 * | 12/2009 | Thayer et al. | 399/71 |
| 2010/0053261 | A1 * | 3/2010 | Thayer et al. | 347/33 |
| 2010/0053292 | A1 * | 3/2010 | Thayer et al. | 347/103 |

FOREIGN PATENT DOCUMENTS

| | | | |
|---|---|---|---|
| JP | 58223164 A | * | 12/1983 |
| JP | 59058457 A | * | 4/1984 |
| JP | 04050963 A | * | 2/1992 |
| JP | 04050994 A | * | 2/1992 |
| JP | 05341696 A | * | 12/1993 |

* cited by examiner

*Primary Examiner* — David M Gray
*Assistant Examiner* — Francis Gray
(74) *Attorney, Agent, or Firm* — Fay Sharpe LLP

(57) ABSTRACT

A blade engagement apparatus moving blades into working positions in engagement with an image forming device moving surface for cleaning and/or metering release agent onto the surface. The blade engagement apparatus includes a pair of spaced apart links having slots receiving pins extending from the blades and an actuator rotating the links for moving the blades along track slots into and out of the working positions. The links couple the blades together for mutually exclusive cooperative movement alternating between the working positions and respective suspended positions wherein the blades are removed from the moving surface.

16 Claims, 9 Drawing Sheets

BLADE ENGAGEMENT APPARATUS FOR IMAGE FORMING MACHINES

BACKGROUND

Disclosed in embodiments herein are apparatuses for cleaning and/or applying release agent to an image forming machine moving surface, such as a photoreceptor, transfer surface, etc., and more specifically a blade engagement apparatus having rotating links moving first and second blades along tracks and into separate working positions in engagement with the moving surface for cleaning and/or metering.

In electrophotographic applications such as xerography, a charge retentive moving photoreceptor belt, plate, or drum is electrostatically charged according to the image to be produced. In a digital printer, an input device such as a raster output scanner controlled by an electronic subsystem can be adapted to receive signals from a computer and to transpose these signals into suitable signals so as to record an electrostatic latent image corresponding to the document to be reproduced on the photoreceptor. In a digital copier, an input device such as a raster input scanner controlled by an electronic subsystem can be adapted to provide an electrostatic latent image to the photoreceptor. In a light lens copier, the photoreceptor may be exposed to a pattern of light or obtained from the original image to be reproduced. In each case, the resulting pattern of charged and discharged areas on moving photoreceptor surface form an electrostatic charge pattern (an electrostatic latent image) conforming to the original image.

The electrostatic image on the moving photoreceptor may be developed by contacting it with a finely divided electrostatically attractable toner. The toner is held in position on the photoreceptor image areas by the electrostatic charge on the surface. Thus, a toner image is produced in conformity with a light image of the original. Once each toner image is transferred to a substrate, and the image is affixed thereto forming a permanent record of the image to be reproduced. In the case of multicolor copiers and printers, the complexity of the image transfer process is compounded, as four or more colors of toner may be transferred to each substrate sheet. Once the single or multicolored toner is applied to the substrate, it is permanently affixed to the substrate sheet by fusing, so as to create the single or multicolor copy or print.

Following the photoreceptor to substrate toner transfer process, it is necessary to at least periodically clean the charge retentive surface of the moving photoreceptor surface. In order to obtain the highest quality copy or print image, it is generally desirable to clean the photoreceptor each time toner is transferred to the substrate. In addition to removing excess or residual toner, other particles such as paper fibers, toner additives and other impurities (hereinafter collectively referred to as "residue") that may remain on the charged moving surface of the photoreceptor.

Further, solid ink jet image forming machines generally use an electronic form of an image to distribute ink melted from a solid ink stick or pellet in a manner that reproduces the electronic image. In some solid ink jet imaging systems, the electronic image may be used to control the ejection of ink directly onto a media sheet. In other solid ink jet imaging systems, the electronic image is used to eject ink onto an intermediate imaging member. A media sheet is then brought into contact with the intermediate imaging member in a nip formed between the intermediate member and a transfer roller. The heat and pressure in the nip helps transfer the ink image from the intermediate imaging member to the media sheet.

One issue arising from the transfer of an ink image from an intermediate imaging member to a media sheet is the transfer of some ink to other machine components. For example, ink may be transferred from the intermediate imaging member to a transfer roller when a media sheet is not correctly registered with the image being transferred to the media sheet. The pressure and heat in the nip may cause a portion of the ink to adhere to the transfer roller, at least temporarily. The ink on the transfer roller may eventually adhere to the back side of a subsequent media sheet. If duplex printing operations are being performed, the quality of the image on the back side is degraded by the ink that is an artifact from a previous processed image.

To address these problems, various release agent applicators have been designed, often as part of an image drum maintenance system. These release agent applicators provide a coating of a release agent, such as silicone oil, onto the intermediate imaging member moving surface to reduce the undesired build-up of ink. It is desired to control the amount of release agent applied, since using of too much release agent causes undesirable streaks, also known as oil streaks, on the output prints.

The present application provides a new and improved apparatus for cleaning and/or metering a release agent onto an image forming device moving surface which overcomes these above-described problems.

DETAILED DESCRIPTION

Figure 1:
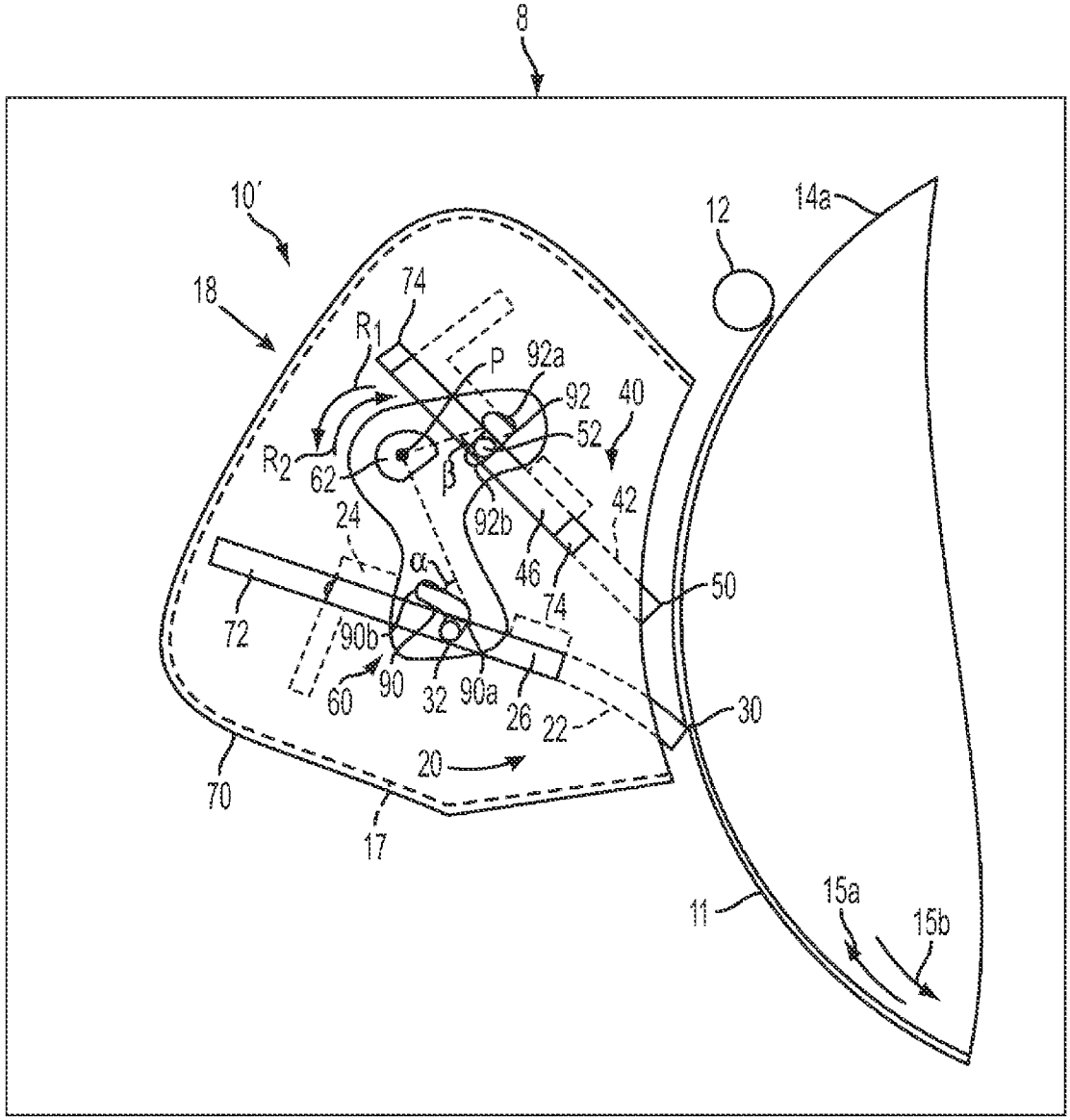
FIG. 1 is an inboard side view illustrating a blade engagement apparatus as described herein with a first blade disposed in a working position for metering release agent onto an associated image forming machine moving surface.
Figure 6:
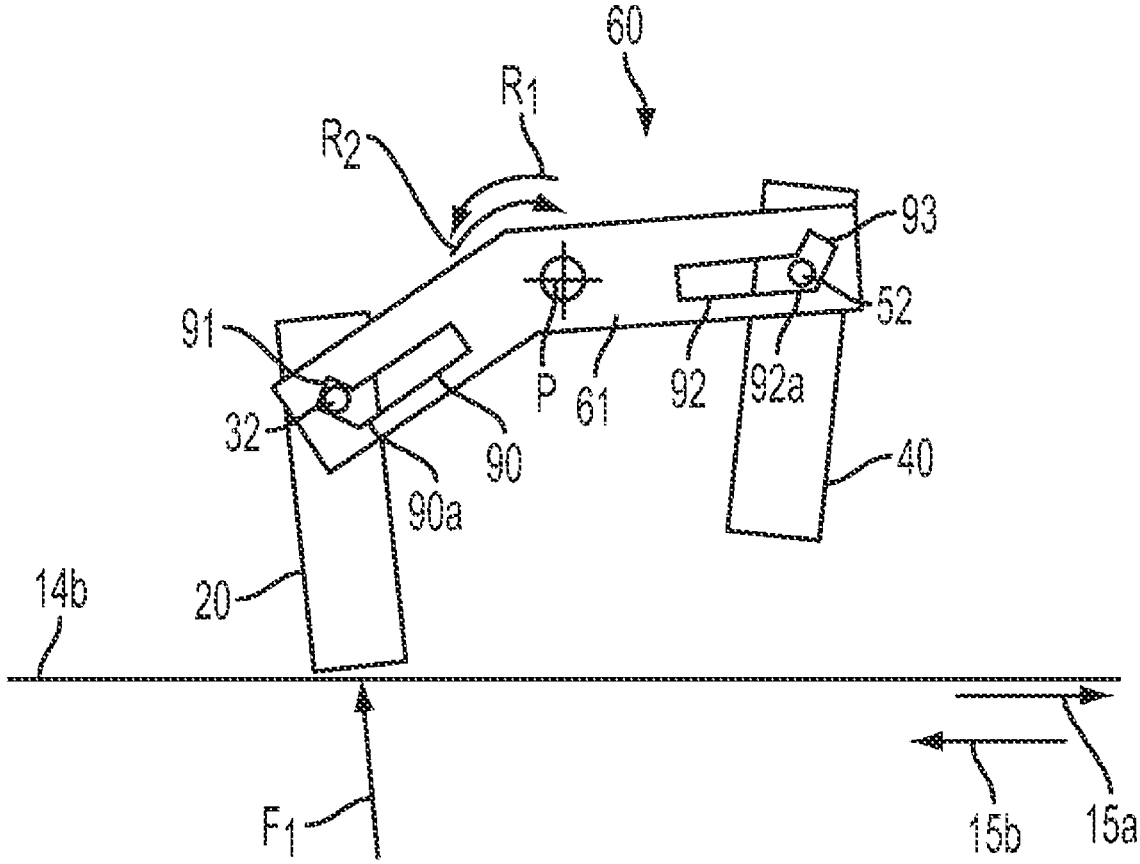
FIG. 6 is a side view of a portion of a blade engagement apparatus illustrating a retaining mechanism for retaining the first blade in the working position.
Figure 7:
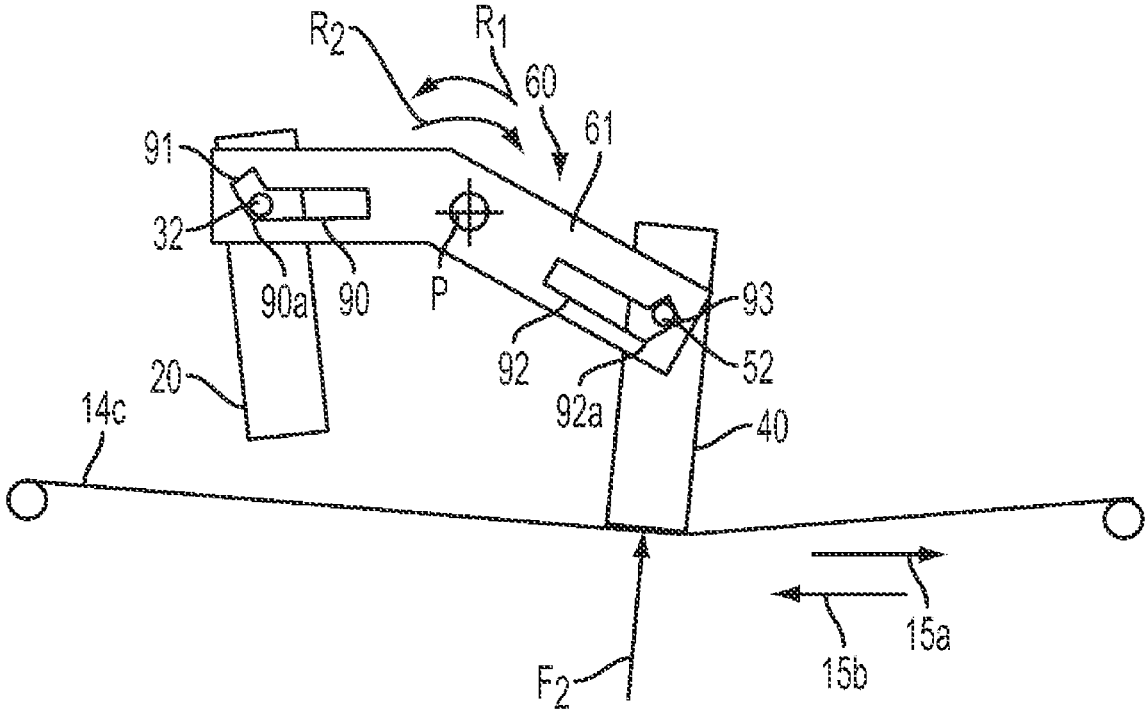
FIG. 7 is a side view of a portion of a blade engagement apparatus illustrating a retaining mechanism for retaining the second blade in the working position.

Referring now to FIG. 1, an image forming machine such as a xerographic copier, printer, multifunction machine, and the like shown generally at 8, includes a moving surface 14 moving in an operational direction 15*a* or 15*b*. The moving surface 14 can be suitable for receiving a controlled application of a release agent, or a surface suitable for cleaning, such as the removal of toner waste material etc., or both. The moving surface 14 can be a cylindrical surface 14*a*, such as a solid ink jet (SIJ) drum used in SIJ machines 8, rotating in an operational direction, 15*a* or 15*b*, as shown in FIGS. 1-5. In other examples, the cylindrical surface 14*a* can be an imaging member, such as a photoreceptor, or a glossing drum, or a transfer surface, or other like surfaces. The image forming machine moving surface 14 can also be a flat surface 14*b*, such as a flat rigid photoreceptor surface or transfer surface, moving in an operational direction, 15*a* or 15*b*, as shown in FIG. 6. The image forming machine moving surface 14 can also be a belt 14*c*, such as a photoreceptor belt, or the like, moving in an operational direction, 15*a* or 15*b*, as shown in FIG. 7. The moving surfaces 14*a*, 14*b*, and/or 14*c*, referred to generally as moving surface 14, can be used in other image forming machines 8 including but not limited to printers, copiers, and multifunction machines.

The image forming machine 8 includes a blade engagement apparatus 10 having a blade positioning mechanism 18 connected to a pair of blades, including a first blade 20 and a second blade 40. The blade positioning mechanism 18 moves the blades 20 and 40 into separate working positions, also referred to as operational positions, in controlled engagement with surface 14 as described in further detail below.

Figure 2:
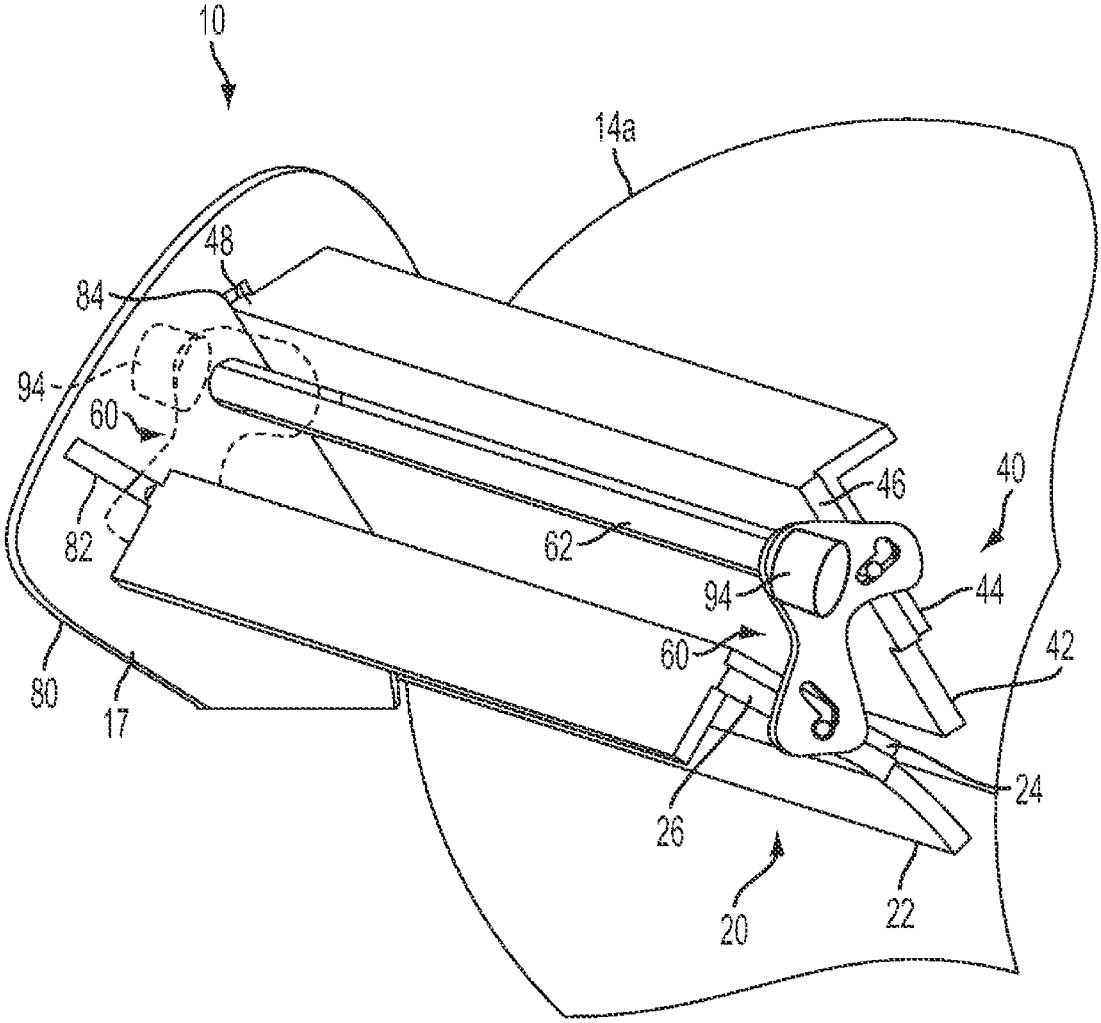
FIG. 2 is a perspective view illustrating the blade engagement apparatus of FIG. 1 disposed in a removable unit having the inboard end and a portion of the housing body removed for clarity.
Figure 3:
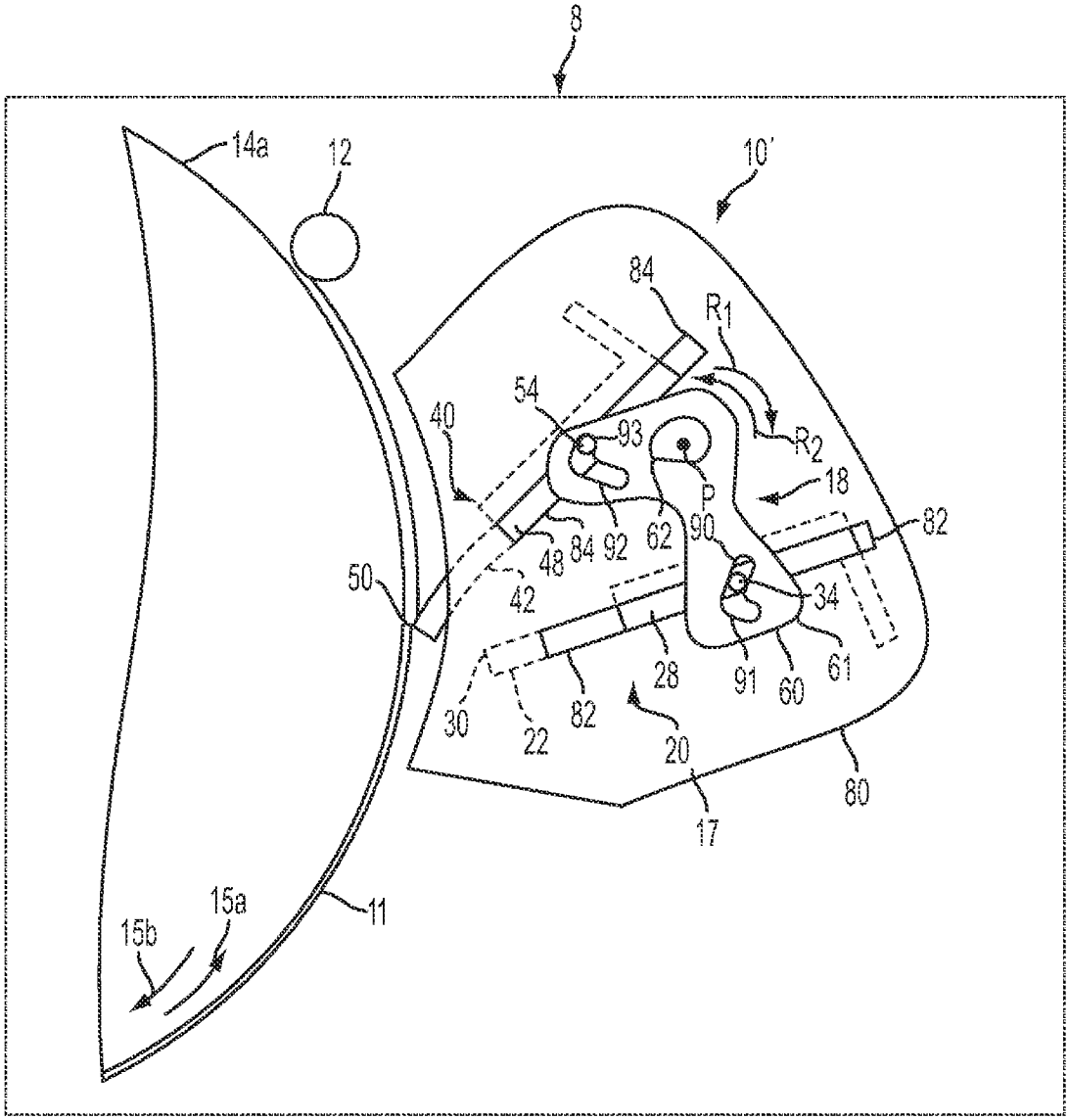
FIG. 3 is an outboard side view illustrating the blade engagement apparatus of FIG. 1, as described herein with a second blade disposed in a working position for metering release agent onto the associated image forming machine moving surface.

The blade engagement apparatus, referred to generally at 10, can be a release agent application apparatus, an example of which is shown at 10' in FIGS. 1-3, for applying a controlled amount (thickness) of release agent 11 to the surface 14, in a process referred to herein as metering. During metering, the release agent 11 is initially applied to the surface 14 using a roller 12, or in other known manners, and then metered to a desired thickness by the blade 20 or 40 disposed in a working position. The blade engagement apparatus 10 can be a cleaning apparatus, an example of which is shown at 10" in FIGS. 4 and 5, for cleaning debris 13 from the moving surface 14 with the blade 20, 40 disposed in the working position. The blade engagement apparatus 10 can be configured for cleaning, or metering, or both simultaneously.

The blade engagement apparatus 10 can be contained in a removable cartridge 17, if so desired, such as for example part of a print cartridge, also referred to a Xerographic Replaceable Unit (XRU). The XRU 17 can be removed from the image forming device 10 and discarded when its useful life has been depleted.

The first blade 20 includes a blade member 22 extending from a blade holder 24 and terminating in a blade tip or edge 30. The second metering blade 40 includes blade member 42 extending from a blade holder 44 and terminating in a blade tip, or edge 50. The blade members 22, 42 are formed of a compliant material, such as polyurethane, which bends, or deflects, as the blades 20, 40 are moved into the working positions in which the blade tips 30, 50 are pressed against surface 14 generating a blade load at the tips against the surface, or material on the surface such as a release agent being metered. The tips 30, 50 can be coated with PMMA, SureLube, toner or other initial blade lubricant to prevent blade flip as the blades 20, 40 are moved into the working positions.

The blade holders 24, 44 are rigid and formed of aluminum, steel, a composite, or other suitably rigid material. The rigid blade holders 24, 44 are connected to, or integrated with, the blade members 22, 42 to evenly distribute the application forces applied to the blades by the blade positioning mechanism 18 along the length of the blades 20, 40.

The blade holders 24, 44 are elongated members disposed adjacent the moving surface 14, extending transversely across it with respect to the operational direction 15*a* or 15*b*. The blade holders 24, 44 include oppositely disposed lateral ends, including inboard end portions 26, 46 and outboard end portions 28, 48, respectively.

The first blade holder 24 includes an inboard pin 32 extending from the inboard end portion 26, and an outboard pin 34 extending from the outboard end portion 28. The pins 32 and 34 can be axially aligned. The second blade holder 44 includes an inboard pin 52 extending from the inboard end portion 46, and an outboard pin 54 extending from the outboard end portion 48. The pins 52 and 54 can also be axially aligned.

The blade positioning mechanism 18 includes a pair of spaced apart support plates disposed in a transverse (with respect to the moving surface 14) facing relationship at opposite ends of the blades 20, 40, including an inboard support plate 70 and outboard support plate 80. The support plates 70, 80 can be part of the replaceable XRU 17 as shown in FIGS. 1-3, or part of frame members fixed to the image forming machine 8, for supporting the blades 20 40 for movement as described below.

The inboard support plate 70 includes a first slot 72 receiving the first blade outboard end portion 26, and a second slot 74 receiving the second blade outboard end portion 46, as shown in FIG. 1. The outboard support plate 80 includes a first slot 82 receiving the first blade inboard end portion 28, and a second slot 84 receiving the second blade inboard end portion 48, as shown in FIG. 3.

The first slots 72 and 82 are laterally aligned so as to extend from the surface 14 at similar angles, to form first tracks for guiding the first blade 20 in controlled movement either towards or away from the surface 14. Similarly, the second slots 74 and 84 are laterally aligned so as to extend from the surface 14 at similar angles forming second tracks for guiding the second blade 40 in controlled movement either towards or away from the surface 14.

The blade positioning mechanism 18 includes a pair of rotating links 60 having flat bodies 61 formed of a rigid material, such as metal, plastic, composites, or the like, connected to opposite, lateral ends of the blades 20, 40, as shown in FIG. 2, to couple the blades together and move the blades along the track slots as described in further detail below.

A drive rod 62 is connected to the link bodies 61 for rotating the links 60 together about a pivot axis P. In the example provided, the drive rod 62 is disposed between the blades 20 and 40, extending laterally between the support plates 70 and 80. The rod 62 includes portions extending beyond the outer sides of both support plates 70 and 80, and the links 60 are fixed to these portions in a spaced apart relationship at the outer sides for coupled, mutual rotation about pivot points P. The links 60 can be angularly aligned with each other and the link bodies 61 can extend in a transverse relationship to the rod 62. Fixed to the drive rod 62 for rotation in this manner, both links 60 move in relatively the same angular range of rotation in spaced apart, transversely extending planes.

The engagement apparatus 10 includes an actuator 94 connected to the drive rod 62 as shown in FIG. 2. The actuator 94 can be a solenoid, or stepper motor, or other bidirectional actuator controlled by controller 95 for rotating the drive rod 62 and the links 60 about the pivot points P in a first rotational direction $R_1$ and an opposite, second rotational direction $R_2$.

A single actuator 94, disposed at the inboard or outboard end, can be used. Alternatively, a pair of actuators 94, one disposed at each end can be used to rotate each corresponding link separately, thereby providing further control over the movement of the blades 20, 40 and the blade loads as described below.

The links 60 each include a first slot 90 formed in the link bodies 61 extending from a radially outer first end 90*a* (with respect to the pivot point P) to a radially inner second end 90*b* at an angle a of between 0 and about 90 degrees (with respect to a radius extending from pivot point P, shown as a dotted line). The first slots 90 receive pins 32 and 34 extending from the first blade 20 for coupling the first blade to the links 60 for cooperative movement, as describe in further detail below.

Figure 4:
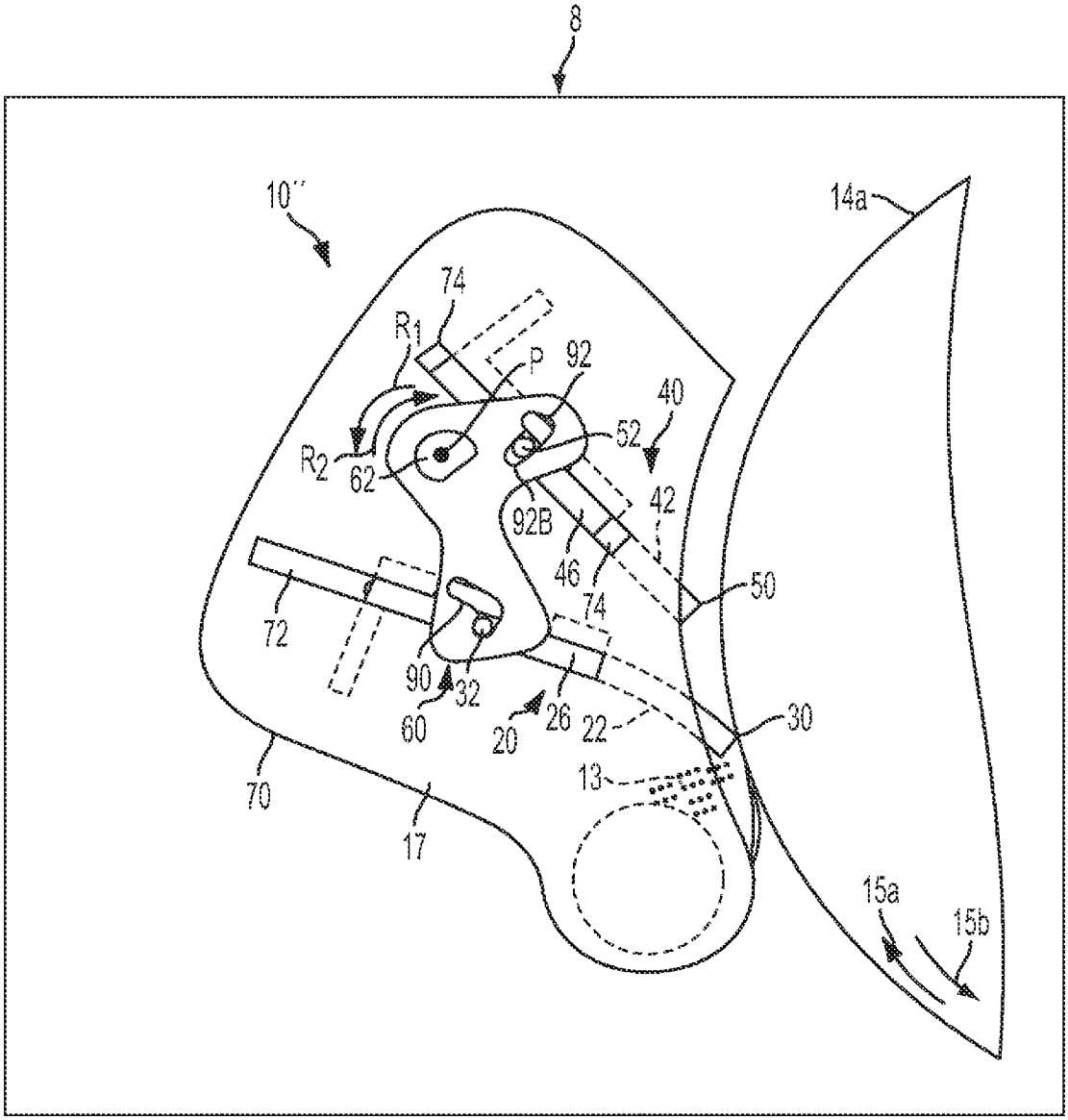
FIG. 4 is an inboard side view illustrating an alternate embodiment of a blade engagement apparatus as described herein with a first blade disposed in a working position for cleaning an associated image forming machine moving surface.

The links 60 each also include a second slot 92 formed in the link bodies 61 extending from a radially outer first end 92*a* (with respect to the pivot point P) to a radially inner second end 92*b* at an angle βof between 0 and about 90 degrees (with respect to a radius extending from pivot point P, shown as a dotted line). The second slots 92 receive pins 52 and 54 extending from the second blade 40 for coupling the second blade to the links 60 for cooperative movement, as describe in further detail below The operation of the blade engagement apparatus 10 shall now be described. The actuator 94 can rotate the drive rod 62 to rotate the links 60 in the first direction $R_1$ about the pivot axes P. The rotating links 60 apply force to the first blade pins 32 and 34, as the pins slide along the first slots 90, in a direction towards the surface 14 moving the first blade end portions 26, 28 along track slots 72, 82, thereby moving the first blade 20 in a direction towards the surface 14 and into the working position as shown in FIGS. 1 and 4. The first blade 20 can now be referred to as the operational blade.

The links 60, rotating in the first rotational direction $R_1$, also apply force to the second pins 52 and 54, as the pins slide along the second slots 92, in a direction away from the surface 14 moving the second blade end portions 46, 48 along the second track slots 74, 84, thereby moving the second blade 40 in a direction away from the surface 14 and into a suspended position where the blade edge 50 is held out of contact with the surface 14 such that it will not be damaged, as shown in FIGS. 1 and 4. The second blade 40 can now be referred to as the non-operational blade.

As the first blade 20 is disposed in the working position, a blade load is generated at the blade tip 30 against surface 14 for metering the release agent onto the surface, as shown in FIG. 1, or for cleaning the surface by removing debris 13 therefrom, as shown in FIG. 4, or both.

The blade load can be increased while the first blade 20 is in the working position by the actuator 94 rotating the links 60 in the first direction $R_1$, thereby moving the first blade holder 24 in a direction towards the surface 14, increasing the deflection of the compliant blade member 22 which can also be referred to as increasing the interference of the blade 20. Increasing the blade load can meter a thinner layer of release agent 11 onto the surface during a metering operation, or clean more debris from the surface during a cleaning operation, or both. The blade load at tip 30 can be decreased while the first blade 20 is in the working position, to meter a thicker layer of release agent and/or remove less debris from surface 14, by the actuator 94 rotating the links 60 in the second direction $R_2$, thereby moving the first blade holder 22 in a direction away the surface 14 while the blade tip 30 remains in contact with the surface.

The blade engagement mechanism 10 can include blades 20, 40 arranged in a wiper blade orientation when disposed in the working position, referred to herein as $WP_{WB}$, as shown by the first blade 20 in FIGS. 1 and 3. In $WP_{WB}$, the tracks 72, 74, 82 and 84 extend at an angle from the surface 14 so as to orient the blade holder 24, 44 (and the blade member 22, 42 as it just extends therefrom) at a blade holder angle (BHA)<90 degrees with surface 14 (or a tangent to the surface). In $WP_{WB}$, BHA is taken at the upstream side of the blade tip 30, 50, wherein upstream is defined with respect to the moving surface operational direction 15*b* as described in further detail in the co-pending application U.S. application Ser. No. 12/201,140 (now U.S. Publication No. 2010/0053293) filed concurrently herewith, entitled "SYSTEM AND METHOD OF ADJUSTING BLADE LOADS FOR BLADES ENGAGING IMAGE FORMING MACHINE MOVING SURFACES" incorporated herein by reference in its entirety.

Figure 5:
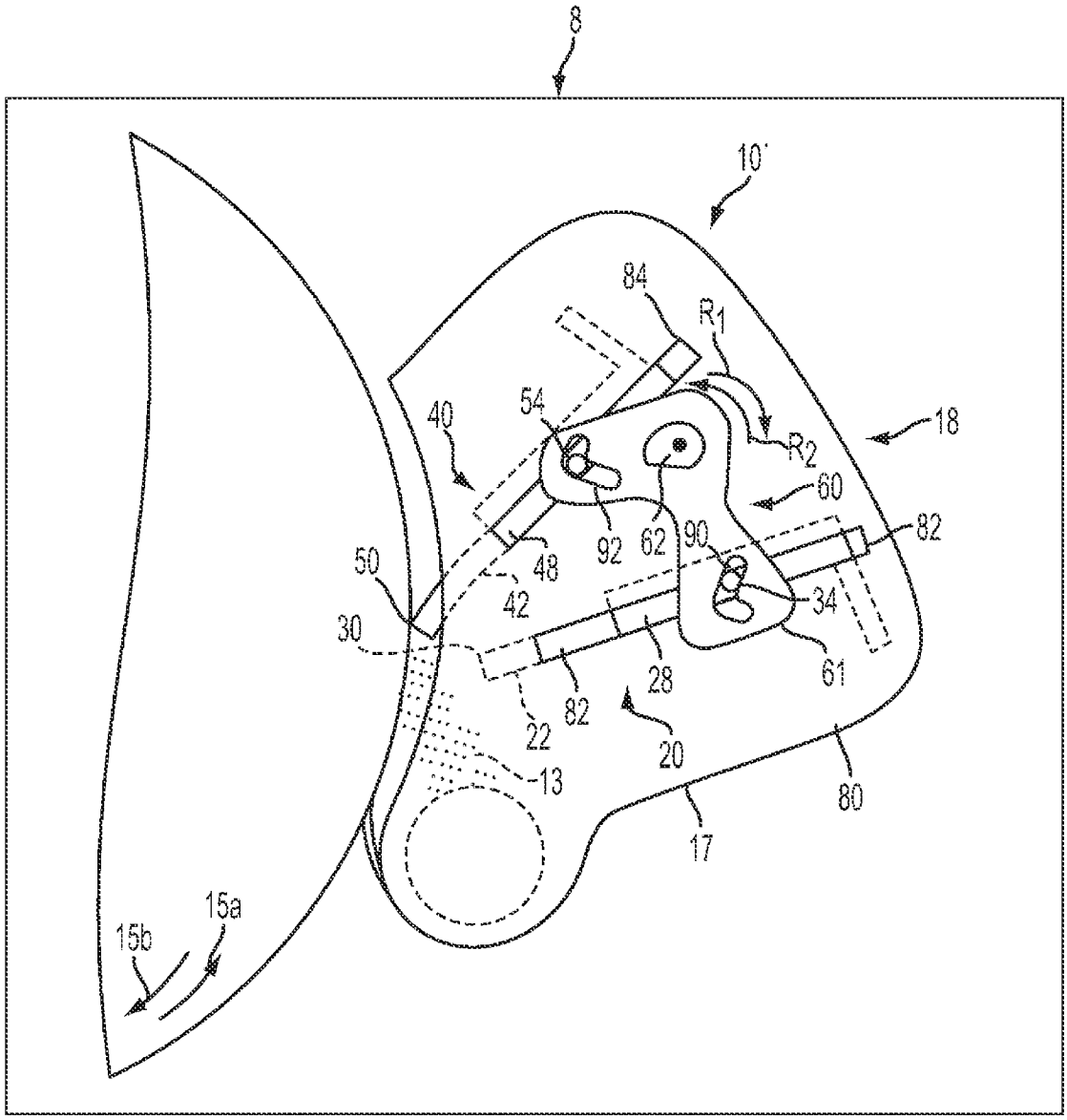
FIG. 5 is an outboard side view illustrating the alternate embodiment of the blade engagement apparatus of FIG. 4 as described herein with a second blade disposed in a working position for cleaning the associated image forming machine moving surface.

Alternatively, the blade engagement mechanism 10 can include blades 20, 40 arranged in a doctor blade orientation when disposed in the working position, referred to herein as $WP_{DB}$, as shown in FIGS. 4 and 5. In $WP_{DB}$, the tracks 72, 74, 82 and 84 extend from the surface 14 so as to orient blade holder 24, 44 (and the blade member 22, 42 as it just extends therefrom) at a BHA<90 degrees with surface 14 (or a tangent to the surface) In $WP_{DB}$, BHA is taken at the downstream side of the blade tip 30, 50, wherein downstream is defined with respect to the moving surface operational direction 15*a* as described in further detail in the co-pending application U.S. application Ser. No. 12/201,140 (now U.S. Publication No. 2010/0053293) filed concurrently herewith, entitled "SYSTEM AND METHOD OF ADJUSTING BLADE LOADS FOR BLADES ENGAGING IMAGE FORMING MACHINE MOVING SURFACES" previously incorporated herein by reference.

At the end of the operational life of the first blade 20, the used blade is withdrawn from operation and the second blade 40 is placed into operation for movement into and out of the working position. The actuator 94 rotates the drive rod 62 to rotate the links 60 in the second direction $R_2$ about the pivot axis P. The rotating links 60 apply force to the first blade pins 32 and 34 as they slide along the first slots 90, in a direction away from the surface 14 moving the first blade end portions 26, 28 along tracks 72, 82 thereby moving the first blade 20 in a direction away from the surface 14 and into a suspended position spaced apart from the surface as shown in FIGS. 3 and 5. The rotating links 60 also apply force to the second blade pins 52 and 54 as they slide along the second slots 92 in a direction towards the surface 14 moving the second blade end portions 46, 48 along the second track slots 74, 84 thereby moving the second blade 40 in a direction towards the surface 14 and into a working position as shown in FIGS. 3 and 5.

The blade load at the second blade tip 50 on surface 14 can be increased while the second blade 40 is in the working position to meter a thinner layer of release agent 11 and/or remove more debris 13 from the surface, by the actuator 94 rotating the links 60 in the second direction $R_2$, thereby moving the second blade holder 44 in a direction towards the surface 14, increasing the deflection of the compliant blade member 42 and increasing the interference of the blade 40. The blade load at the second blade tip 50 can be decreased while the second blade 40 is in the working position, to meter a thicker layer of release agent and/or remove less debris from surface 14 during cleaning, by the actuator 94 rotating the links 60 in the first direction $R_1$, thereby moving the second blade holder 42 in a direction away the surface 14.

Sensors can be used to monitor for streaks on output prints or on moving surface 14 and actuator 94 can provide incremental bidirectional changes in rotation to links 60 to make small changes in the blade load to achieve a minimum blade load needed for preventing streaks during image forming, as described in further detail in the co-pending application U.S. application Ser. No. 12/201,140 (now U.S. Publication No. 2010/0053293) filed concurrently herewith entitled "SYSTEM AND METHOD OF ADJUSTING BLADE LOADS FOR BLADES ENGAGING IMAGE FORMING MACHINE MOVING SURFACES" previously incorporated herein by reference. By using two actuators 94 and intentionally allowing the blades 20, 40 to skew in the guide track slots 72, 84, 82, and 84, it is possible to vary the blade interference, and thus the blade load, differently at each end.

During use, the operational blade 20 or 40, can be repeatedly moved out of the working position and into an operational standby position disengaged from the surface 14 such that the blade tip 30 or 50 is suspended therefrom, and then moved back into the working position in engagement with surface 14, by rotating the links 60 through a smaller range of angular motion than is required for the blade replacement procedure described above. The non-operational blade 40 or 20 can be moved between two non-operational suspended positions keeping the corresponding blade edge 50 or 30 separated from the surface 14. In this manner, the operational blade 20 or 40 can be moved into the working position for cleaning and/or metering operations and then withdrawn into the operational standby position to prevent the blade from interfering with the moving surface 14 during other stages of the image forming process.

The rotating links 60, coupled to the first and second blades 20, 40 as described above, moves both blades simultaneously in opposite directions, with respect to the moving surface 14. Track slots 72, 74, 82, 84 guide the blades in controlled movement, providing stable support to the blade holders 24, 44 and good control over alignment tolerances so that the blades 20, 40 are accurately oriented and loaded against the surface 14 in the working positions.

The blade engagement apparatus can include a mechanism for retaining the blades 20, 40 in their respective working positions. In one example embodiment as illustrated in reference to the inboard link 60 shown in FIGS. 6 and 7, the first slots 90 each include a notched portion 91 extending from the first end 90*a*. As the links 60 are rotated in the first direction $R_1$ and the first blade 20 is moved into the working position in engagement with surface 14 as shown in FIG. 6, the first blade pins 32 and 34 slide along the first slot 90 towards the first end 90*a* and are received into the notched portions 91 as shown. The notches 91 provide surfaces abutting the first blade pins 32 and 34 for counteracting the forces $F_1$ tending to move the first blade 20 away from the surface 14 along the first track slots 72 and 82, thereby retaining the first blade 20 in the working position. Rotating the links 60 in the second rotational direction $R_2$ moves the first blade pins 32 and 34 out of the notched portion 91 so they are free to slide along notch 90 towards the second end 90*b* allowing the first blade 20 to be moved out of the working position.

As shown in FIG. 7, the second slots 92 each include a notched portion 93 extending from the first end 92*a*. Notches 93 provide surfaces for abutting the second blade pins 52 and 54 for counteracting the forces $F_2$ (tending to move the second blade 40 away from the surface 14 along the second track slots 74 and 84). The second blade pins 52 and 54 slide along the second slot 92 towards the first end 92*a* and into the notched portion 93 as the links 60 are rotated in the second rotational direction $R_2$, thereby retaining the second blade 40 in the working position as shown. Rotating the links 60 in the first rotational direction $R_1$ moves the second blade pins 52 and 54 out of the notched portion 93 so they are again free to slide along notch 92 towards the second end 92*b* allowing the second blade 40 to be moved out of the working position.

Figure 8A:
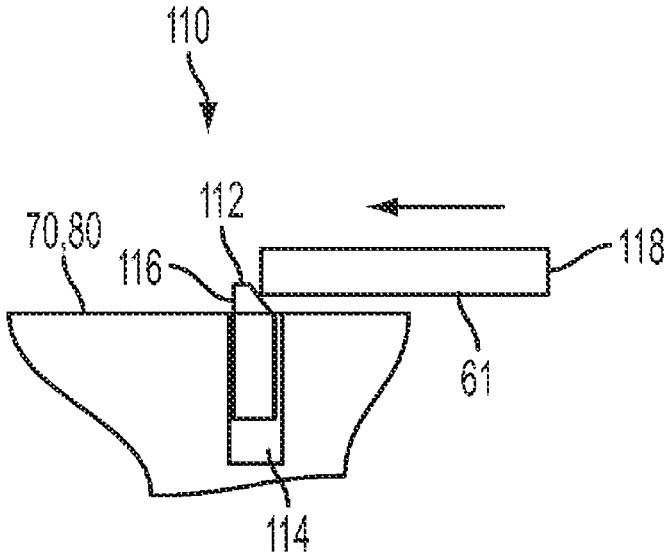
FIGS. 8*a* and 8*b* illustrate an alternate embodiment of the retaining mechanism for retaining the first or second blade in the working position.
Figure 8B:
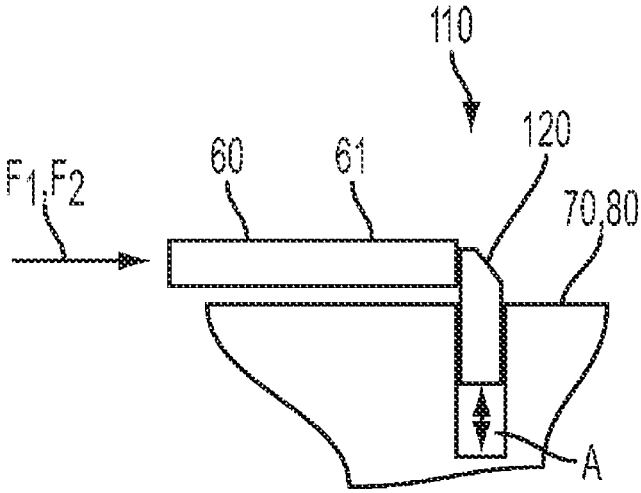

Another example embodiment of a retaining mechanism for retaining the blades 20, 40 in their respective working positions is a latch shown generally at 110 in FIGS. 8*a* and 8*b*. For the purposes of simplicity a single latch 110 is shown, and described, cooperating with one of the links 60, though it should be appreciated that a pair of latches, one disposed at each lateral end for cooperating with each link can be used. The latch 110 includes a latch member 112 extending from an aperture 114 in the support plate 70, 80. The latch member 112 includes an abutment surface 116 for abutting a surface 118 of the link body 61 facing away from the surface 14 to counter act the force F1, F2 tending to move the blade 20, 40 away from the surface and out of the working position.

The latch member 112 can include a beveled surface 120 disposed opposite the abutment surface 116 which cooperates with the rotating link (the rotational movement being illustrated by the arrow) to deflect the latch member 112 into the aperture 114 thereby allowing the link to rotate past the latch member and move the blade 20, 40 into the working position as shown in FIG. 8*b*. In the working position, the latch member extends from the aperture 114 such that the abutment surface 116 abuts the link body 61 preventing the link from rotating in the opposite direction thus retaining the blade in the working position. An actuator A can be used to withdraw the latch member back into the aperture 114 allowing the link 60 to be rotated by actuator 94 for moving the blade 20, 40 out of the working position as described above.

Figure 9A:
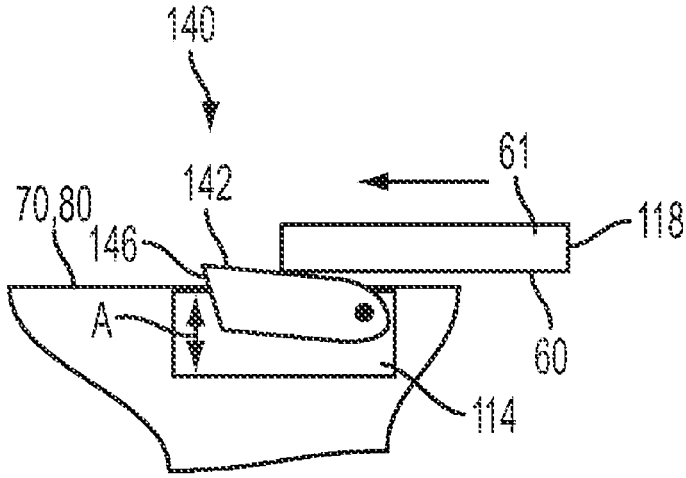
FIGS. 9*a* and 9*b* illustrate another alternate embodiment of the retaining mechanism for retaining the first or second blade in the working position.
Figure 9B:
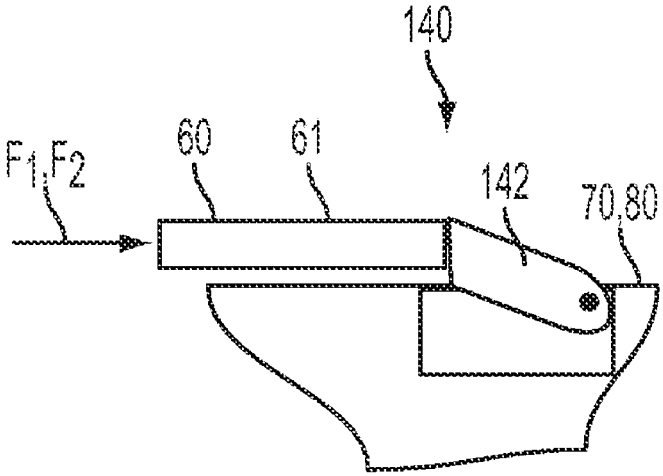

Another example embodiment of a retaining mechanism in the form of a rotating latch, shown generally at 140, for retaining the blades 20, 40 in their respective working positions is shown in FIGS. 9*a* and 9*b*. For the purposes of simplicity a single latch 140 is shown (and described) cooperating with one of the links 60, though it should be appreciated that a pair of latches, one disposed at each lateral end for cooperating with each link can be used. The latch 140 includes a latch member 142 extending from an aperture 114 in the support plate 70, 80. The latch member 142 includes an abutment surface 146 for abutting a surface 118 of the link body 61 facing away from the surface 14 to counter act the force $F_1$, $F_2$ tending to move the blade 20, 40 away from the surface and out of the working position.

The latch member 142 can be pivot at an end disposed opposite the abutment surface 146 between a recessed position shown in FIG. 9*a*, and an extended position shown in FIG. 9*b*. In the recessed position, the latch member 142 is disposed within the aperture 144 allowing the link 60 to rotate past the latch member to bring the blade 20, 40 into the working position. As the link 60 rotates past the latch member, the latch member is pivoted into the extended position so that the abutment surface 146 extends from the support plate 70, 80 abutting a surface 118 of the link body 61 facing away from the surface 14 to counter act the force $F_1$, $F_2$ tending to move the blade 20, 40 away from the surface and out of the working position. An actuator A can be used to withdraw the latch member 142 back into the aperture 144 allowing the link 60 to be rotated by actuator 94 for moving the blade 20, 40 out of the working position as described above.

The blade engagement apparatus 10 is configured to simplify the replacement of the operational blade 20 or 40, thereby increasing the useful life of the application apparatus between service intervals previously required for blade replacement operations. The life of the blade engagement apparatus 10 is increased with high reliability to more than twice the life of a conventional single blade system.

Blade changes can be initiated based on accumulated blade use, or blade failure identified by a failure sensor or the customer. Failure sensors can detect metering failures on the photoreceptor before they appear on prints, leading to blade replacements before customers are aware of faults.

If the application apparatus 10 is contained within an XRU 17, the system can be easily replaced by replacing the XRU. The two blade application apparatus life would therefore be matched to the expected life of the other XRU components. For example, if a conventional XRU 17 having a single blade system has a blade life that is slightly longer than the life of the photoreceptor 14, then when a long life overcoat is applied to the photoreceptor to double its life, the blade life will become inadequate. A doubling of the expected useful life of the blade would typically more than triple the number of blade failures. Thus, the blade would then become the life limiter for the XRU. Changing from a conventional single blade to the two blade application apparatus 10 will enable a long life XRU more suitable for use with the overcoated photoreceptor.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An apparatus providing controlled blade engagement with an associated image forming machine moving surface comprising:

a first elongated blade having a first pin disposed at a first end and a second pin disposed at a second end opposite the first end;

a second elongated blade having a third pin disposed at a first end and a fourth pin disposed at a second end opposite the first end;

a pair of spaced apart support members disposed in a facing relationship at the first and second ends of the first and second blades, the support members each having a first track slot receiving the first blade for sliding movement towards and away from the associated image forming machine moving surface and a second track slot receiving the second blade for sliding movement towards and away from the associated image forming machine moving surface;

a pair of spaced apart links including a first link disposed at the first ends of the first and second blades including a rigid body having a first slot receiving the first pin and a second slot receiving the third pin and a second link disposed at the second ends of the first and second blades including a rigid body having a first slot receiving the second pin and a second slot receiving the fourth pin;

an actuator rotating the first and second links in a first rotational direction moving the first blade along the first track slots and into a working position engaging the associated image forming machine moving surface, the actuator rotating the first and second links in a second rotational direction moving the second blade along the second track slots and into a working position engaging the associated image forming machine moving surface.

2. The apparatus defined in claim 1 further comprising:

the actuator rotating the links in the first rotational direction moving the second blade along the second track slots into a suspended position spaced apart from the associated moving surface as the first blade is moved into the working position; and the actuator rotating the links in the second rotational direction moving the first blade along the first track slots into a suspended position spaced apart from the associated moving surface as the second blade is moved into the working position.

3. The apparatus defined in claim 1 further comprising:

a drive rod connected to the actuator for rotation in first and second rotational directions, the drive rod connected to the first and second links for rotating the links in the first and second rotational directions.

4. The apparatus defined in claim 1 further comprising:

the first slots each include a first portion having an end and a notched portion formed in the end and communicating with the first portion, the notched portion receiving one of the first blade pins for retaining the first blade in the working position, and wherein the second slots each include a first portion having an end and a notched portion formed in the end and communicating with the first portion, the notched portion receiving one of the second blade pins for retaining the second blade in the working position.

5. The apparatus defined in claim 1 further comprising:

a latch extending from a support member and having a surface abutting a link for retaining the first blade or second blade in the working position.

6. The apparatus defined in claim 1 wherein the first and second blades are oriented in doctor blade orientations with respect to the associated moving surface while disposed in the working positions.

7. The apparatus defined in claim 1 wherein the first and second blades are oriented in wiper blade orientations with respect to the associated moving surface while disposed in the working positions.

8. The apparatus defined in claim 1 wherein the apparatus is a metering apparatus moving the first and second blades into working positions for metering release agent onto the associated moving surface.

9. The apparatus defined in claim 1 wherein the apparatus is a cleaning apparatus moving the first and second blades into working positions for cleaning debris from the associated moving surface.

10. The apparatus defined in claim 1 wherein the actuator rotates the first and second links in a first rotational direction moving the first blade disposed in a working position in a direction towards the associated moving surface thereby increasing the blade load at the moving surface and wherein the actuator rotates the first and second links in a second rotational direction moving the first blade disposed in a working position in a direction away from the associated moving surface thereby decreasing the blade load at the moving surface.

11. The apparatus defined in claim 10 wherein the actuator rotates the first and second links in the second rotational direction moving the second blade disposed in a working position in a direction towards the associated moving surface thereby increasing the blade load at the moving surface and wherein the actuator rotates the first and second links in the first rotational direction moving the second blade disposed in a working position in a direction away from the associated moving surface thereby decreasing the blade load at the moving surface.

12. The apparatus defined in claim 10 further comprising a replaceable unit having a housing enclosing the blades and end portions forming the support members.

13. A cleaning apparatus providing controlled blade engagement with an associated image forming machine moving surface for cleaning the moving surface comprising:

a first elongated blade having a first pin disposed at a first end and a second pin disposed at a second end opposite the first end;

a second elongated blade having a third pin disposed at a first end and a fourth pin disposed at a second end opposite the first end;

a pair of spaced apart links including a first link disposed at the first ends of the first and second blades including a rigid body having a first slot receiving the first pin and a second slot receiving the third pin and a second link disposed at the second ends of the first and second blades including a rigid body having a first slot receiving the second pin and a second slot receiving the fourth pin;

an actuator rotating the first and second links in a first rotational direction moving the first blade into a working position in cleaning engagement with the associated image forming machine moving surface, the actuator rotating the first and second links in a second rotational direction moving the second blade into a working position in cleaning engagement with the associated image forming machine moving surface.

14. The cleaning apparatus defined in claim 13 further comprising a pair of spaced apart support members disposed in a facing relationship at the first and second ends of the first and second blades, the support members each having a first track slot receiving the first blade for sliding movement towards and away from the associated image forming machine moving surface and a second track slot receiving the second blade for sliding movement towards and away from the associated image forming machine moving surface.

15. A metering apparatus providing controlled blade engagement with an associated image forming machine moving surface for metering a release agent on to the moving surface comprising:

a first elongated blade having a first pin disposed at a first end and a second pin disposed at a second end opposite the first end;

a second elongated blade having a third pin disposed at a first end and a fourth pin disposed at a second end opposite the first end;

a pair of spaced apart links including a first link disposed at the first ends of the first and second blades including a rigid body having a first slot receiving the first pin and a second slot receiving the third pin and a second link disposed at the second ends of the first and second blades including a rigid body having a first slot receiving the second pin and a second slot receiving the fourth pin;

an actuator rotating the first and second links in a first rotational direction moving the first blade into a working position engaging the associated image forming machine moving surface for metering a controlled amount of release agent, the actuator rotating the first and second links in a second rotational direction moving the second blade into a working position engaging the associated image forming machine moving surface for metering a controlled amount of release agent.

16. The metering apparatus defined in claim 15 further comprising a pair of spaced apart support members disposed in a facing relationship at the first and second ends of the first and second blades, the support members each having a first track slot receiving the first blade for sliding movement towards and away from the associated image forming machine moving surface and a second track slot receiving the second blade for sliding movement towards and away from the associated image forming machine moving surface.

* * * * *